US010765141B2

(12) United States Patent
John et al.

(10) Patent No.: US 10,765,141 B2
(45) Date of Patent: Sep. 8, 2020

(54) MATERIAL FOR INCLUSION IN A SMOKING ARTICLE

(71) Applicant: British American Tobacco (Investments) Limited, London (GB)

(72) Inventors: Edward John, London (GB); Joceyln Benning, London (GB); Steven Coburn, London (GB); Alice Lance, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 248 days.

(21) Appl. No.: 15/542,177

(22) PCT Filed: Jan. 5, 2016

(86) PCT No.: PCT/GB2016/050013
§ 371 (c)(1),
(2) Date: Jul. 7, 2017

(87) PCT Pub. No.: WO2016/110689
PCT Pub. Date: Jul. 14, 2016

(65) Prior Publication Data

US 2018/0255827 A1 Sep. 13, 2018

(30) Foreign Application Priority Data

Jan. 7, 2015 (GB) ..... 1500176.1

(51) Int. Cl.

| | |
|---|---|
| ***A24B 15/16*** | (2020.01) |
| ***A24B 15/14*** | (2006.01) |
| ***A24B 15/12*** | (2006.01) |
| ***A24B 15/30*** | (2006.01) |

(52) U.S. Cl.
CPC ..... *A24B 15/16* (2013.01); *A24B 15/12* (2013.01); *A24B 15/14* (2013.01); *A24B 15/303* (2013.01)

(58) Field of Classification Search
CPC ..... A24B 15/16; A24B 15/14; A24B 15/303
USPC ..... 131/353
See application file for complete search history.

(56) References Cited

U.S. PATENT DOCUMENTS

| | | | |
|---|---|---|---|
| 3,404,690 | A | 10/1968 | Moshy |
| 3,404,691 | A | 10/1968 | Moshy |
| 3,410,279 | A | 11/1968 | Moshy |
| 3,924,642 | A | 12/1975 | Eicher |
| 4,186,756 | A | 2/1980 | Takemoto |
| 4,333,484 | A | 6/1982 | Keritsis |

(Continued)

FOREIGN PATENT DOCUMENTS

| | | | |
|---|---|---|---|
| CA | 1225900 | A | 5/1987 |
| DE | 2262829 | A1 | 7/1974 |

(Continued)

OTHER PUBLICATIONS

English translation of Peterson, JP-11151082-A, Jun. 1999, Japan (Year: 1999).*

(Continued)

*Primary Examiner* — Michael J Felton
(74) *Attorney, Agent, or Firm* — Cantor Colburn LLP

(57) ABSTRACT

The invention relates to a smokeable sheet material for inclusion in a smoking article (1), the sheet material comprising greater than 39.5% by weight acacia gum.

18 Claims, 4 Drawing Sheets

(56) References Cited

U.S. PATENT DOCUMENTS

| | | | | |
|---|---|---|---|---|
| 4,681,126 | A | 7/1987 | Strubel | |
| 4,770,194 | A | 9/1988 | Ohashi | |
| 4,832,791 | A | 5/1989 | Detert | |
| 5,097,851 | A | 3/1992 | Ehling | |
| 2003/0145869 | A1 | 8/2003 | Kitao | |
| 2003/0178039 | A1 | 9/2003 | White | |
| 2004/0025894 | A1 | 2/2004 | Beven | |
| 2004/0094171 | A1 | 5/2004 | Wanna | |
| 2004/0247746 | A1 | 12/2004 | Pearce | |
| 2005/0039767 | A1* | 2/2005 | Mua | A24B 3/14 131/370 |
| 2005/0244521 | A1 | 11/2005 | Strickland | |
| 2006/0090769 | A1 | 5/2006 | Woodson | |
| 2006/0130862 | A1* | 6/2006 | Dittrich | A24B 15/16 131/364 |
| 2007/0246055 | A1 | 10/2007 | Oglesby | |
| 2007/0251658 | A1* | 11/2007 | Gedevanishvili | A24B 15/282 162/139 |
| 2008/0206432 | A1 | 8/2008 | Torrens | |
| 2009/0301504 | A1 | 12/2009 | Worthen | |
| 2011/0139164 | A1 | 6/2011 | Mua | |
| 2011/0220130 | A1 | 9/2011 | Mua | |
| 2012/0152264 | A1 | 6/2012 | Coleman | |
| 2014/0318563 | A1* | 10/2014 | Tosas Fuentes | A24C 5/005 131/365 |
| 2015/0114414 | A1* | 4/2015 | Fritzsching | A24D 1/02 131/352 |

FOREIGN PATENT DOCUMENTS

| | | | | | |
|---|---|---|---|---|---|
| FR | 1262779 | | | 5/1960 | |
| GB | 824324 | | | 6/1956 | |
| GB | 909699 | | | 11/1958 | |
| GB | 1013303 | | | 8/1962 | |
| GB | 1171043 | | | 7/1968 | |
| GB | 1284151 | | | 8/1972 | |
| GB | 1296908 | | | 11/1972 | |
| JP | 5542538 | A | | 3/1980 | |
| JP | 11151082 | A | * | 6/1999 | A24D 1/025 |
| WO | 9732492 | A1 | | 9/1997 | |
| WO | 2008150130 | A1 | | 12/2008 | |
| WO | 2015004483 | A1 | | 1/2015 | |

OTHER PUBLICATIONS

International Preliminary Report on Patentability for corresponding application PCT/GB2016/050013 filed Jan. 5, 2016; dated Mar. 29, 2017.

International Search Report for corresponding application PCT/GB2016/050013 filed Jan. 5, 2016; dated Mar. 23, 2016.

Written Opinion for the International Searching Authority for corresponding application PCT/GB2016/050013 filed Jan. 5, 2016; dated Mar. 23, 2016.

* cited by examiner

| Cigarette Sample | Cigarette Weight (g) | Circumference (mm) | Firmness (%) |
|---|---|---|---|
| Tobacco Control | 0.84 | 24.8 | 73.2 |
| Tobacco + 20% Comparator Sheet | 0.95 | 24.8 | 72.1 |
| Tobacco + 40% Comparator Sheet | 1.08 | 24.6 | 70.0 |
| Tobacco + 20% Acacia Gum Sheet | 0.92 | 24.7 | 70.3 |
| Tobacco + 40% Acacia Gum Sheet | 1.03 | 24.7 | 70.3 |

Figure 4

| Smoke Constituent | Sample Name / Unit | Tobacco Control | | Tobacco + 20% Comparator Sheet | | Tobacco + 40% Comparator Sheet | | Tobacco + 20% Acacia Gum Sheet | | Tobacco + 40% Acacia Gum Sheet | |
|---|---|---|---|---|---|---|---|---|---|---|---|
| | | Average | % Change | Average | % Change | Average | % Change | Average | % Change | Average | % Change |
| NO | [µg/cig] | 230.53 | 0.0 | 237.91 | 3.2 | 210.69 | -8.6 | 211.58 | -8.2 | 169.00 | -26.7 |
| NOx | [µg/cig] | 265.60 | 0.0 | 272.10 | 2.4 | 239.90 | -9.7 | 241.38 | -9.1 | 192.51 | -27.5 |
| NFDPM | [mg/cig] | 21.62 | 0.0 | 18.67 | -13.6 | 17.55 | -18.8 | 20.51 | -5.1 | 16.85 | -22.1 |
| Nicotine | [mg/cig] | 1.79 | 0.0 | 1.62 | -9.5 | 1.33 | -25.7 | 1.73 | -3.4 | 1.37 | -23.5 |
| CO | [mg/cig] | 20.30 | 0.0 | 18.28 | -10.0 | 17.89 | -11.9 | 17.87 | -12.0 | 16.40 | -19.2 |
| NNN | [ng/cig] | 132.00 | 0.0 | 116.13 | -12.0 | 78.27 | -40.7 | 101.60 | -23.0 | 70.17 | -46.8 |
| NAT | [ng/cig] | 107.07 | 0.0 | 89.47 | -16.4 | 69.31 | -35.3 | 83.33 | -22.2 | 58.91 | -45.0 |
| NAB | [ng/cig] | 15.59 | 0.0 | 12.80 | -17.9 | 9.72 | -37.7 | 12.09 | -22.5 | 8.52 | -45.3 |
| NNK | [ng/cig] | 56.77 | 0.0 | 49.76 | -12.3 | 42.57 | -25.0 | 44.41 | -21.8 | 35.77 | -37.0 |

Figure 5

| Smoke Constituent | Sample Name / Unit | Tobacco + 20% Comparator Sheet | | Tobacco + 20% Acacia Gum Sheet | | Tobacco + 40% Comparator Sheet | | Tobacco + 40% Acacia Gum Sheet | |
|---|---|---|---|---|---|---|---|---|---|
| | | Average | % Change | Average | % Change | Average | % Change | Average | % Change |
| NO | [µg/cig] | 237.91 | 0.0 | 211.58 | -11.1 | 210.69 | 0.0 | 169.00 | -19.8 |
| NOx | [µg/cig] | 272.10 | 0.0 | 241.38 | -11.3 | 239.90 | 0.0 | 192.51 | -19.8 |
| NFDPM | [mg/cig] | 18.67 | 0.0 | 20.51 | 9.9 | 17.55 | 0.0 | 16.85 | -4.0 |
| Nicotine | [mg/cig] | 1.62 | 0.0 | 1.73 | 6.8 | 1.33 | 0.0 | 1.37 | 3.0 |
| CO | [mg/cig] | 18.28 | 0.0 | 17.87 | -2.2 | 17.89 | 0.0 | 16.40 | -8.3 |
| NNN | [ng/cig] | 116.13 | 0.0 | 101.60 | -12.5 | 78.27 | 0.0 | 70.17 | -10.3 |
| NAT | [ng/cig] | 89.47 | 0.0 | 83.33 | -6.9 | 69.31 | 0.0 | 58.91 | -15.0 |
| NAB | [ng/cig] | 12.80 | 0.0 | 12.09 | -5.5 | 9.72 | 0.0 | 8.52 | -12.3 |
| NNK | [ng/cig] | 49.76 | 0.0 | 44.41 | -10.8 | 42.57 | 0.0 | 35.77 | -16.0 |

MATERIAL FOR INCLUSION IN A SMOKING ARTICLE

TECHNICAL FIELD

The invention relates to a smokeable sheet material for inclusion in a smoking article, the sheet material comprising acacia gum.

BACKGROUND

Acacia gum is used in combustible products for purposes such as encapsulation of flavourants or diluents, use as a binder, or to form coatings on paper such as the wrapper of a smoking article.

SUMMARY

In accordance with a first aspect of the present invention there is provided a smokeable sheet material for inclusion in a smoking article, the sheet material comprising a filler, and greater than 39.5% acacia gum by weight.

In some embodiments according to the first aspect, the smokeable sheet material comprises at least 39.9, 40, 41, 42, 43, 44, 45, 46, 47, 48, 49, 50, 55, 60, 65, 70, 75, 80 or 85% acacia gum by weight.

In some embodiments, the filler comprises one or more of an alginate, glycerol and chalk.

In some embodiments according to the first aspect, the smokeable sheet material comprises no more than 40%, 35%, 30%, 25%, 20%, 15%, 10%, 5%, 4%, 3%, 2%, 1% or 0.5% tobacco by weight. In some embodiments, the sheet material does not comprise tobacco.

In some embodiments according to the first aspect, the smokeable sheet material does not comprise substantially solid or particulate matter of a size greater than 800 μm, 700 μm, 600 μm, 550 μm, 500 μm, 400 μm, 200 μm, 180 μm, 100 μm or 5 μm. In some embodiments, the smokeable sheet material does not comprise solid or particulate matter of a size substantially greater than 550 μm. In some embodiments, the smokeable sheet material does not comprise more than 5%, 4%, 3%, 2% or 1% by weight of solid or particulate matter of a size substantially greater than 500 μm.

According to a second aspect, there is provided a method of preparing a sheet of smokeable material for inclusion in a smoking article, wherein the method comprises preparing, casting and drying a solution comprising acacia gum, wherein the amount of acacia gum in the solution is at least 39.5% by weight of the solid content of the solution.

In some embodiments, the amount of acacia gum in the solution is at least 39.9, 40, 41, 42, 43, 44, 45, 46, 47, 48, 49, 50, 55, 60, 65, 70, 75, 80 or 85% by weight of the solid content of the solution.

In some embodiments, the solution further comprises a filler. In some embodiments the filler comprises one or more of an alginate, chalk or glycerol.

In some embodiments, the amount of tobacco in the solution is no more than 40%, 35%, 30%, 25%, 20%, 15%, 10%, 5%, 4%, 3%, 2%, 1% or 0.5% by weight of the solid content of the solution.

In some embodiments, the amount of solid or particulate matter of a size greater than 500 μm in the solution is no more than 5%, 4%, 3%, 2% or 1% by weight of the solid content of the solution.

According to a third aspect there is provided a smoking article comprising a smokeable sheet material according to the first aspect. In some embodiments, the smoking article further comprises tobacco.

According to a fourth aspect, there is provided the use of a smokeable sheet material comprising acacia gum to reduce the level of one or more of the constituents of mainstream smoke generated upon use of a smoking article.

BRIEF DESCRIPTION OF THE DRAWINGS

Embodiments of the invention will now be described, by way of example only, with reference to the accompanying drawings, in which:

FIG. 4 shows the tabulated data for FIG. 3.

FIG. 5 shows the tabulated data demonstrating the reduction of certain analytes achieved by incorporating a smokeable sheet material comprising acacia gum and a filler into a smoking article, compared to Comparator smokeable sheet material not containing acacia gum at the same inclusion levels.

DETAILED DESCRIPTION

Figures 1, 2:
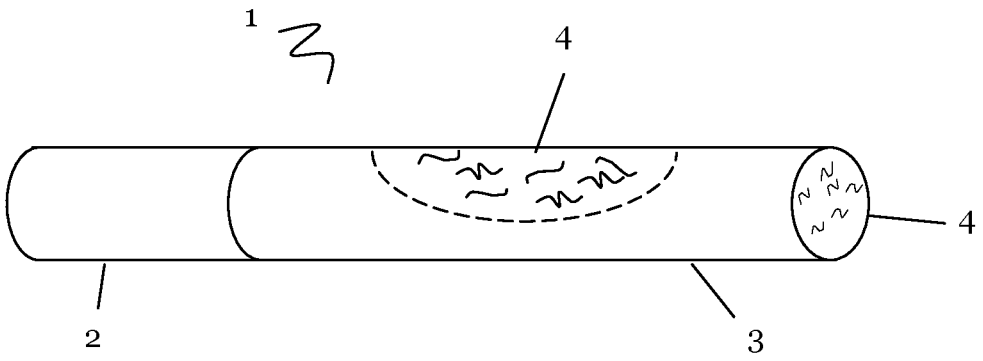
FIG. 1 is a representation of a smoking article in accordance with a third aspect of the present invention.
FIG. 2 is a table showing the results of quality testing module (QTM) physical analysis of cigarettes comprising smokeable sheet material comprising acacia gum and a filler; cigarettes comprising comparator sheet, and tobacco control cigarettes.

Smoke arising from a smoking article which comprises tobacco is a complex, dynamic mixture of more than 5000 identified constituents. The constituents are present in the mainstream smoke (MS), which exits the mouth end of the cigarette, and are also released between puffs as constituents of sidestream smoke (SS).

It can be a research objective to decrease levels of at least some of the constituents of mainstream smoke, such as one or more of aromatic amines; phenols; carbonyls; polycyclic aromatic hydrocarbons; acrylonitrile; volatile hydrocarbons such as toluene, isoprene, styrene and benzene; nitrogen heterocyclics such as pyridine; tobacco-specific nitrosamines (TSNAs) such as N'-nitrosoanabasine (NAB), N'-nitrosoanatabine (NAT), 4-(methylnitrosamino)-1-(3-pyridyl)-1-butanone (NNK) and N'-nitrosonornicotine (NNN); and inorganic compounds such as ammonia, hydrogen cyanide, nitric oxide and carbon monoxide.

Methods for selectively reducing mainstream smoke and/or sidestream smoke constituents may include reducing the levels of certain compounds from the starting material by, for example, using biotechnological methods; blending of different types of tobacco, or treating the tobacco prior to incorporation into the smoking article; reducing the amount of tobacco in the smoking article by including diluents or fillers; ventilation of the smoking article, where ambient air is drawn into the smoking article to dilute the MS; and use of a filter, which enhances the removal of MS constituents. In addition, attempts have been made to selectively remove or reduce constituents from cigarette smoke by incorporating sorbents into the smoking article.

Acacia gum, which is also known as gum Arabic, meska or chaar gund, is made of the sap taken from two species of acacia tree (Acacia seyal and Acacia senegal). Its main component is arabin, which is the calcium salt of the polysaccharide arabic acid.

Acacia gum has a variety of uses. It is frequently included in soft drink syrups and confectionary in the food industry, and is used as a binder and/or emulsifying agent, suspending agent or viscosity increasing agent in certain pharmaceuticals and cosmetics.

Acacia gum has also been used in combustible products for purposes such as encapsulation of, for example, diluents; as a vehicle for, for example, flavourants; use as a binder; and to form coatings on paper such as the wrapper of a smoking article.

It has now been discovered that incorporation of a sheet material comprising acacia gum and a filler into smokeable material for incorporation into a smoking article selectively decreases the level of one or more constituents in the mainstream smoke generated from such articles in use. The reductions were greater than those observed for the corresponding non-acacia gum containing Comparator sheets. Furthermore, the observed reductions for several of the measured constituents were greater than the reduction observed for nicotine, indicating that the reductions were a result of more than simple dilution of the tobacco by the sheet material. In addition, the observed reductions for several of the constituents were greater than expected by the reduction observed for nicotine-free dry particulate matter (NFDPM).

The term "NFDPM" is a term of the art, determined utilising a test methodology as would be understood by a skilled person. It is defined as the weight of mainstream smoke particulate matter trapped on a high efficiency particulate filter, minus the weight of nicotine and water on the filter. It is usually expressed in weight units of milligrams per cigarette.

Accordingly, in a first aspect there is provided a smokeable sheet material for inclusion in a smoking article, the sheet material comprising a filler, and greater than 39.5% acacia gum by weight.

The term "by weight" means by weight of the smokeable sheet material.

In some embodiments, the smokeable sheet material comprises at least 39.9, 40, 41, 42, 43, 44, 45, 46, 47, 48, 49, 50, 55, 60, 65, 70, 75, 80 or 85% acacia gum by weight.

In some embodiments, the resultant sheet is not overly brittle, thereby facilitating handling and processing.

In some embodiments, the filler comprises one or more of a binder, a diluent and a filling agent, such as an inorganic filling agent.

Examples of binders include alginate, pectin, cellulose compounds and hydrocolloid based compounds.

As used herein, the term 'diluent' means a material which can be used to dilute the smokeable material. Examples include glycerol, solanesol, neophytadiene, 3-methylanisole, eugenol, 1-phenyl-1-pentanone, 2,3-dimethyl-4-ethylacetophenone, nicotinic acid, docosane, dotriacontane, eicosane, neophytadiene, heneicosane, hentriacontane, heptacosane, hexacosane, nonacosane, octacosane, pentacosane, pentatriacontane, squalene, tetracosane, tetratriacontane, triacetin, triacontane, triacosane and tritriacontane.

Examples of filling agents include calcium carbonate, perlite, vermiculite, diatomaceous earth, colloidal silica, magnesium oxide, magnesium sulphate and magnesium carbonate.

In some embodiments, the binder is an alginate, such as sodium alginate, the diluent is glycerol and the filling agent is chalk. Accordingly, in some embodiments the filler comprises one or more of an alginate, such as sodium alginate, glycerol and chalk. In some embodiments, the filler comprises an alginate, such as sodium alginate, chalk and glycerol.

In some embodiments, the amount of sodium alginate is from about 5% to about 15% by weight of the sheet material. In some embodiments, the amount of chalk is from about 10% to about 50% by weight of the smokeable sheet material. In some embodiments, the amount of glycerol is from about 5% to about 25% by weight of the smokeable sheet material.

In some embodiments, the amount of sodium alginate is about 7.5% by weight of the smokeable sheet material. In some embodiments, the amount of chalk is about 40% by weight of the smokeable sheet material. In some embodiments, the amount of glycerol is about 12.5% by weight of the smokeable sheet material.

In some embodiments, the smokeable sheet material does not comprise tobacco, or comprises tobacco at no more than 40%, 35%, 30%, 25%, 20%, 15%, 10%, 5%, 4%, 3%, 2%, 1% or 0.5% by weight of the sheet material.

In some embodiments, the smokeable sheet material does not comprise substantially solid or particulate matter of a size greater than 800 μm, 700 μm, 600 μm, 550 μm, 500 μm, 400 μm, 200 μm, 180 μm, 100 μm or 50 μm. In some embodiments, the smokeable sheet material does not comprise solid or particulate matter of a size substantially greater than 550 μm. In some embodiments, the smokeable sheet material does not comprise more than 5%, 4%, 3%, 2% or 1% by weight solid or particulate matter of a size substantially greater than 500 μm.

In some embodiments, the smokeable sheet material, when used as part of a smoking article comprising tobacco, gives rise to reduced levels of one or more constituents of mainstream smoke. In some embodiments, reductions in mainstream smoke constituents may include, but are not restricted to, one or more of those substances known as Hoffmann analytes.

The term 'Hoffmann analytes' is a term of art. It relates to a group of constituents of mainstream smoke generated from a smoking article, and includes aromatic amines; phenols; carbonyls; polycyclic aromatic hydrocarbons; acrylonitrile; volatile hydrocarbons such as toluene, isoprene, styrene and benzene; nitrogen heterocyclics such as pyridine; and TSNAs such as N'-nitrosoanabasine (NAB), N'-nitrosoanatabine (NAT), 4-(methylnitrosamino)-1-(3-pyridyl)-1-butanone (NNK) and N'-nitrosonornicotine (NNN); and inorganic compounds such as ammonia, hydrogen cyanide, nitric oxide (NO) and carbon monoxide (CO).

According to a second aspect, there is provided a method of preparing a sheet of smokeable material for inclusion in a smoking article, wherein the method comprises preparing, casting and drying a solution comprising acacia gum, wherein the amount of acacia gum in the solution is at least 39.5% by weight of the solid content of the solution.

The term "solid content" means all of the components (whether dispersible or dissolvable in the solvent), other than the solvent, comprising the sheet of smokeable material.

In some embodiments, the amount of acacia gum in the solution is at least 39.9, 40, 41, 42, 43, 44, 45, 46, 47, 48, 49, 50, 55, 60, 65, 70, 75, 80 or 85% by weight of the solid content of the solution.

The solution may be prepared using an aqueous solvent. In some embodiments, the solvent may be water. In some embodiments, the water may be distilled or deionized water.

In some embodiments, the solution further comprises a filler.

In some embodiments, the filler comprises one or more of a binder, a diluent and a filling agent, such as an inorganic filling agent. In some embodiments, the binder is an alginate, such as sodium alginate, the diluent is glycerol and the filling agent is chalk. Accordingly, in some embodiments, the filler comprises one or more of an alginate, such as sodium alginate, glycerol and chalk. In some embodiments, the filler comprises an alginate, such as sodium alginate, glycerol and chalk.

In some embodiments, the amount of sodium alginate in the solution is from about 5% to about 15% by weight of the solid content of the solution. In some embodiments, the amount of chalk in the solution is from about 10% to about 50% by weight of the solid content of the solution. In some embodiments, the amount of glycerol is from about 5% to about 25% by weight of the solid content of the solution.

In some embodiments, the amount of sodium alginate in the solution is about 7.5% by weight of the solid content of the solution. In some embodiments, the amount of chalk in the solution is about 40% by weight of the solid content of the solution. In some embodiments, the amount of glycerol is about 12.5% by weight of the solid content of the solution.

In some embodiments, the amount of tobacco in the solution is no more than 40%, 35%, 30%, 25%, 20%, 15%, 10%, 5%, 4%, 3%, 2%, 1% or 0.5% by weight of the solid content of the solution. In some embodiments, the solution does not comprise tobacco.

In embodiments wherein the solution further comprises a component, such as a binder, a diluent, a filling agent or tobacco, and one or more of these components is not soluble or is only partially soluble in the solvent, a slurry will be formed. Where the solvent is water, the slurry will be an aqueous slurry.

In some embodiments, the prepared solution or slurry prior to casting does not comprise solid or particulate matter of a size greater than 800 μm, 700 μm, 600 μm, 550 μm, 500 μm, 400 μm, 200 μm, 180 μm, 100 μm or 50 μm. In some embodiments, the smokeable sheet material does not comprise substantially solid or particulate matter of a size greater than 550 μm. In some embodiments, the amount of solid or particulate matter of a size greater than 500 μm is no more than 5%, 4%, 3%, 2% or 1% by weight of the solid content of the solution.

In some embodiments, one or more of the components may be prepared as one or more separate solutions or slurries, using the solvent, and then combined. Alternatively, the solution or slurry may be prepared by mixing or blending one or more of the components with the solvent and then adding the additional components. The components and/or solutions or slurries comprising the components may be prepared using a forceful blending means, such as high shear mixing means.

The solution or slurry may be cast using conventional means, for example on a casting sheet, and dried using conventional means and conditions, for example in an oven using a temperature of about 80° C. for about 90 minutes. The resultant sheets may then be conditioned using conventional means, for example, a conditioning cabinet at about 60% relative humidity and 22° C. for up to about 24, or longer if required, for example, 48 hours.

Smokeable sheet material comprising acacia gum may be incorporated into a smoking article, such as a cigarette. Accordingly, in a third aspect there is provided a smoking article comprising a smokeable sheet material according to the first aspect.

Smoking articles typically comprise a filter at the mouth end, a rod which comprises smokeable material, and paper wrapped around the rod.

The smokeable material may comprise one or more of the components typically found in the tobacco rod of a combustible product such as a smoking article. For example tobacco lamina, tobacco stem, expanded tobacco, reconstituted tobacco, extruded tobacco, tobacco substitutes, and filler materials.

In some embodiments according to the third aspect, the smokeable sheet material may is be incorporated and/or mixed with one or more components of the smokeable material for incorporation into the smoking article. In some embodiments the smokeable sheet material may be located within the tobacco rod.

Smoking articles according to the third aspect may conform to any size or dimensions known for smoking articles.

Alternatively, smoking articles according to the third aspect may comprise a coaxial core, comprising an inner core and outer annulus of smokeable materials, and wherein smokeable sheet material comprising acacia gum may be incorporated into either or both of the inner core or outer annulus. In such embodiments, the smoking article may comprise the same or different wrapper materials for the inner core and outer annulus.

Smoking articles according to the third aspect may comprise any filter configuration known in the art. Filters for smoking articles typically comprise one or more of fibrous cellulose acetate, polypropylene material, polyethylene material, or gathered paper material.

Referring to FIG. 1, a smoking article, 1, is illustrated comprising a filter, 2 and a substantially cylindrical tobacco rod, 3, aligned with the filter, 2, such that one end of the tobacco rod, 3, abuts the end of the filter. The tobacco rod, 3, has a cut away area to demonstrate the location of shredded smokeable sheet material comprising a filler and acacia gum, 4. The tobacco rod, 3 is joined to the filter, 2, by tipping paper in a conventional manner.

According to a fourth aspect, there is provided the use of a smokeable sheet material comprising acacia gum to reduce the level of one or more of the constituents of mainstream smoke generated upon use of a smoking article. In some embodiments, reductions in mainstream smoke constituents may include, but are not restricted to, one or more of those substances known as Hoffmann analytes.

In some embodiments, the sheet material is shredded, comminuted or otherwise reduced to a size suitable for incorporation into a smoking article. Size reduction may be achieved using conventional means, such as a shredder. The shredded sheet material may then be mixed with tobacco and/or other constituents of the smokeable material and incorporated into a smoking article.

In some embodiments, the sheet material may be located within the tobacco rod.

Alternatively, the sheet material may be provided as a wrap or lining for other constituents of the smokeable material.

Without wishing to be bound by any theory, it is suggested that the effects resulting from incorporation of a smokeable sheet material comprising acacia gum into a smoking article arise from a change in the combustion and/or pyrolysis profile of the components of the smokeable material. This may be as a result of the physical presence of the acacia gum, which exerts physicochemical effects on thermal processes within the combustion and/or pyrolysis zones, resulting in reductions of analytes.

The observation that the reductions were greater than expected by reduction of NFDPM for some of the substances in mainstream smoke may indicate that synergistic effects could be occurring within the complex, dynamic combustion and/or pyrolysis processes occurring within the smoking article. In addition, the observation that the reductions in TSNAs were greater than the reduction of nicotine indicates that the reductions in TSNAs are a result of more than simple dilution of the tobacco by the sheet material, and that, whilst not wishing to be bound by any theory, mechanisms may be occurring during the combustion process in the cigarettes comprising smokeable sheet material comprising acacia gum and a filler which result in enhanced reductions of some analytes compared with cigarettes comprising Comparator sheet.

The following examples are provided to illustrate the present invention and should not be construed as limiting thereof.

EXAMPLE 1

Preparation of Sheet Material Comprising Acacia Gum and a Filler

A sheet comprising acacia gum and a filler ("Acacia gum sheet") was prepared using components as detailed in Table A.

TABLE A

| Components | Slurry composition (g) | Sheet component (dry weight) (%; rounded up) |
|---|---|---|
| Sodium Alginate | 18.76 | 7.5 |
| Chalk | 100 | 40 |
| Glycerol | 31.26 | 12.5 |
| *Acacia* gum (granules) | 100 | 40 |
| Water | 750 | |
| Slurry (sheet component) ingredients as a percentage of total slurry weight | 25.00% | |

Sodium alginate (Protanal® RF 6650 obtained from FMC BioPolymer) was added slowly to 400 ml water and blended for approximately five minutes on high speed.

In a separate blender, the acacia gum was added to 200 ml water and blended for 5-10 minutes until milky.

The remaining 150 ml water was used to rinse the glycerol into the alginate mixture, and the mixture was blended for 2-5 minutes.

The chalk (Calcitec V100, size range 99%<500 μm; obtained from Mineraria Sacilese s.p.a.) was then slowly added to the glycerol and alginate mixture while blending on a high setting, then blended for a further five minutes.

The hydrated acacia gum solution was added to the alginate mixture, and blended for a further five minutes until a smooth slurry was achieved.

The slurry mixture was then cast on casting sheets to a two millimetre thickness, and placed in an oven set to 80° C. for about 90 minutes.

The casting sheets were removed from the oven and left to cool. They were then placed in a conditioning cabinet set to 60% relative humidity and 22° C. for an appropriate period of time for the sheet to reach equilibrium water content (typically between 12-48 hours).

The sheets were removed using a doctoring knife and placed in bags and stored at approximately 4° C.

Comparator Sheet

A pre-prepared comparator sheet not containing acacia gum was used, details of which are provided in Table B.

TABLE B

| Ingredient | CAS no. | Sheet component (dry weight) (%) | Other information |
|---|---|---|---|
| Calcium carbonate | 471-34-1 | 78.5 | Conforms to British & European Pharmacopoeia |
| Glycerol | 56-81-5 | 12.5 | British Pharmacopoeia, E422 |
| Sodium alginate | 9005-38-3 | 7.5 | Food grade, E401 |
| Caramel | 8028-89-5 | 1.5 | Food Grade E150a |

The sodium alginate used for the Comparator sheet was Protanal® RF 6650, obtained from FMC BioPolymer.

Details of a typical method of manufacture for the Comparator sheet can be found in the paper by McAdam et al., Food and Chemical Toxicology 49 (2011) 1684-1696.

Preparation of Cigarettes Comprising Sheet Materials

Acacia gum sheets prepared according to the methodology set out above, and Comparator sheets without acacia gum were shredded using an Intimus 007 SX shredder. The required quantities were weighed out and added to a US style tobacco blend. In addition, a control comprising tobacco only was prepared.

Details of all the mixtures created are provided in Table C, below.

TABLE C

| Blend Sample | Amount of *Acacia* Gum Sheet (g) | Amount of Comparator Sheet (g) | Amount of Tobacco (g) | Total *Acacia* Gum in Blend (g) |
|---|---|---|---|---|
| Tobacco Control | 0 | 0 | 600 | 0 |
| Tobacco + 20% Comparator Sheet | 0 | 120 | 480 | 0 |
| Tobacco + 40% Comparator Sheet | 0 | 240 | 360 | 0 |
| Tobacco + 20% *Acacia* Gum Sheet | 120 | 0 | 480 | 48 |
| Tobacco + 40% *Acacia* Gum Sheet | 240 | 0 | 360 | 96 |

The mixtures were mixed by hand in a large flexible container bag by introducing air, agitating the bag vigorously, and visually inspecting for homogeneity.

Cigarettes were made using a Marshall McGearty Cigarette Maker ("mini maker"). The mini maker is a non-automated process used in small scale cigarette production.

Tobacco is placed into the hopper, and compressed by a suitable weight. A portion is then segregated in a compression chamber and formed into a cylindrical rod and introduced into a cigarette spill, through the filling nozzle, using a lever. Five spills can be filled at one time. The weights on the tobacco can be varied and affects the amount of tobacco entering the segregation chamber and hence the spill. This in turn affects the firmness value of the cigarette which is measured using a quality testing module.

A consistent firmness of 70% was targeted in all samples, in order to reduce variation between cigarettes.

Another measure used in reducing variation was weight selection. 40 cigarettes were individually weighed for each sample and statistically analysed to calculate the upper and lower weight values of the middle 70% range of the data. Cigarettes were selected from this range for smoke analysis.

A quality testing module physical analysis of the cigarettes was carried out. Results are shown in FIG. 2.

Cigarettes meeting the weight criteria were then smoked using the smoking regime detailed in Table D, below, and the mainstream smoke from each cigarette was analysed.

TABLE D

| | |
|---|---|
| Puff Volume (mL) | 55 |
| Puff Duration (s) | 2.0 |
| Puff Frequency (s) | 30 |
| Ventilation | Closed |

Five replicates were carried out, with five cigarettes smoked per replicate. The mainstream smoke from each cigarette was analysed, and the mean of the replicates was calculated.

Results

Figure 3:
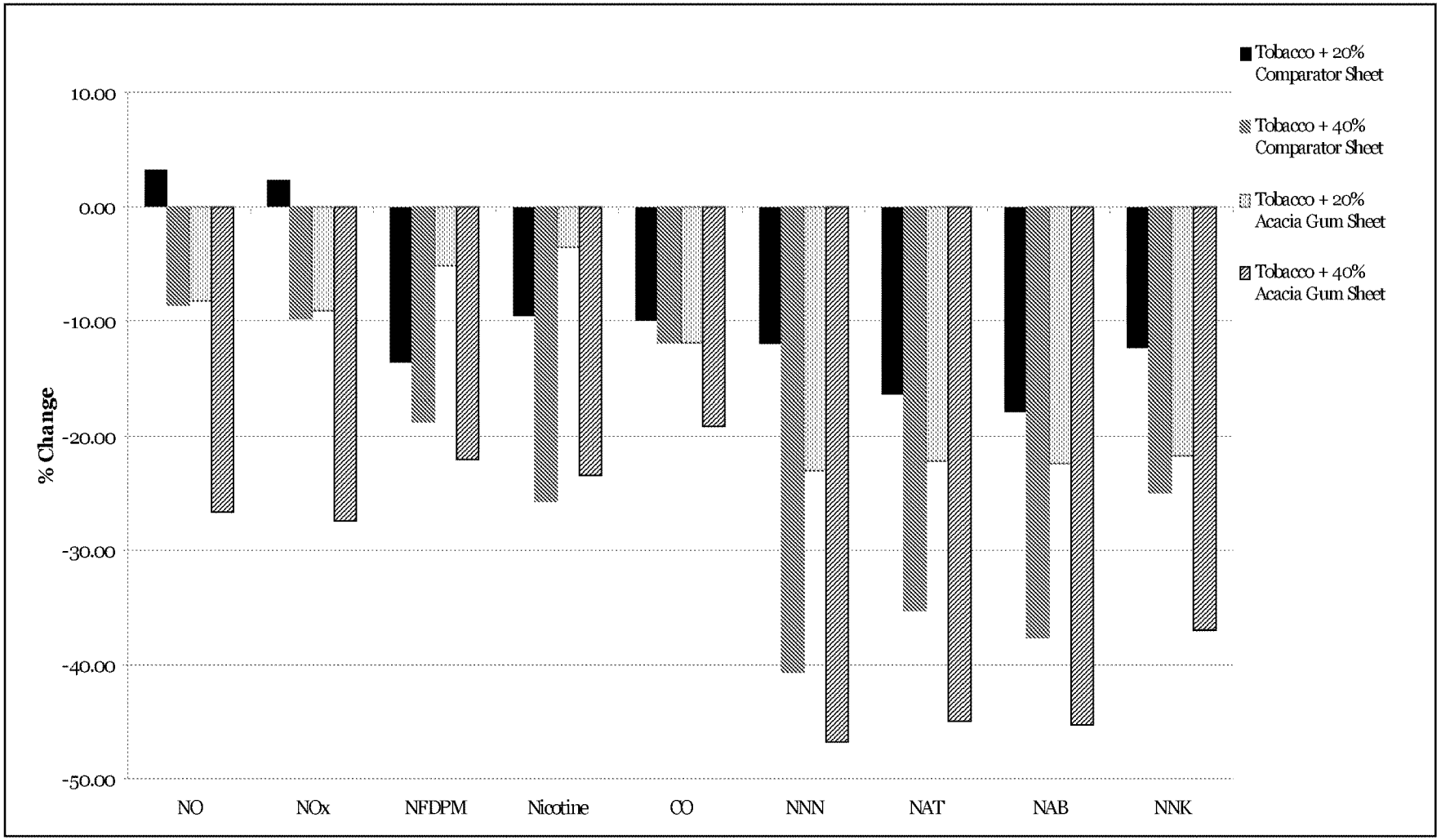
FIG. 3 is a graph demonstrating the reduction of certain analytes achieved by incorporating a smokeable sheet material comprising acacia gum and a filler into a smoking article, compared to a control made from 100% tobacco.

FIG. 3 shows a graph of the percentage change of selected mainstream smoke analytes for both the acacia gum and Comparator sheet cigarettes when compared with the tobacco control cigarettes. FIG. 4 tabulates the percentage change together with the absolute mainstream smoke yields of all cigarettes.

Cigarettes containing 20% smokeable sheet material comprising acacia gum and a filler ("Tobacco+20% Acacia Gum Sheet") reduced levels of NO, NOx (the total of NO plus $NO_2$), CO, NNN, NAT, NAB and NNK in comparison to the tobacco control and the corresponding 20% Comparator sheet containing cigarettes.

Similarly, cigarettes containing 40% smokeable sheet material comprising acacia gum and a filler ("Tobacco+40% Acacia Gum Sheet") reduced levels of NO, NOx, CO, NNN, NAT, NAB and NNK in comparison to the tobacco control and the corresponding 40% Comparator sheet containing cigarettes.

Furthermore, the observed reductions for several of these constituents NO, NOx, CO, NNN, NAT, NAB and NNK in cigarettes containing 20% smokeable sheet material comprising acacia gum and a filler ("Tobacco+20% Acacia Gum Sheet") were greater than the reduction observed for nicotine, indicating that the reductions in TSNAs are a result of more than simple dilution of the tobacco by the sheet material.

Similarly, the observed reductions for several of these constituents NO, NOx, NNN, NAT, NAB and NNK in cigarettes containing 40% smokeable sheet material comprising acacia gum and a filler ("Tobacco+40% Acacia Gum Sheet") were greater than the reduction observed for nicotine, indicating that the reductions in TSNAs are a result of more than simple dilution of the tobacco by the sheet material.

Further to this, the levels of NO, NOx, CO, NNN, NAT, NAB and NNK were reduced to a greater extent than the reduction achieved by NFDPM in cigarettes containing 20% smokeable sheet material comprising acacia gum and a filler ("Tobacco+20% Acacia Gum Sheet"); and the levels of NO, NOx, nicotine, NNN, NAT, NAB and NNK were reduced to a greater extent than the reduction achieved by NFDPM in cigarettes containing 40% smokeable sheet material comprising acacia gum and a filler ("Tobacco+40% Acacia Gum Sheet").

Further to this, FIG. 5 shows that the smokeable sheet material comprising acacia gum and a filler was more effective than the Comparator sheet in reducing some analytes. For example, both the "Tobacco+20% Acacia Gum Sheet" and "Tobacco+40% Acacia Gum Sheet" reduced NO, NOx, CO, NNN, NAT, NAB and NNK when compared with "Tobacco+Comparator sheet" at the corresponding inclusion levels. Without wishing to be bound by any theory, it is suggested that, since nicotine levels were not reduced, mechanisms may be occurring during the combustion process in the cigarettes comprising smokeable sheet material comprising acacia gum and a filler which result in enhanced reductions of some analytes compared with cigarettes comprising Comparator sheet.

Also, some analytes, for example, NO, NOx, CO, NNN, NAT, NAB and NNK, were reduced for the "Tobacco+Acacia Gum Sheet" at both 20 and 40% inclusion levels when compared with the "Tobacco+Comparator sheet" at the corresponding inclusion levels by a greater amount than NFDPM yield generated.

In order to address various issues and advance the art, the entirety of this disclosure shows, by way of illustration, various embodiments in which the claimed invention may be practiced and provide for a superior process for preparing smokeable sheet material for inclusion in a smoking article. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A smokeable sheet material for inclusion in a smoking article, the sheet material comprising a filler and greater than 39.5% acacia gum by weight, wherein the sheet material does not comprise substantially solid or particulate matter of a size greater than 50 μm, wherein the sheet material comprises no more than 25% tobacco by weight.

2. A smokeable sheet material according to claim 1, comprising at least 39.9, 40, 41, 42, 43, 44, 45, 46, 47, 48, 49, 50, 55, 60, 65, 70, 75, 80 or 85% acacia gum by weight.

3. A smokeable sheet material according to claim 1, wherein the filler comprises one or more of alginate, chalk and glycerol.

4. A smokeable sheet material according to claim 1, wherein the sheet material comprises no more than 20%, 15%, 10%, 5%, 4%, 3%, 2%, 1% or 0.5% tobacco by weight.

5. A smokeable sheet material according to claim 1, wherein the sheet material does not comprise tobacco.

6. A method of preparing a sheet of smokeable material for inclusion in a smoking article wherein the method comprises preparing, casting and drying a solution or slurry comprising a filler and acacia gum, wherein the amount of acacia gum in the solution or slurry is at least 39.5% by weight of the solid content of the solution or slurry, wherein the solution or slurry prior to casting does not comprise solid or particulate matter of a size greater than 50 μm, where the amount of tobacco in the solution or slurry is no more than 25% by weight of the solid content of the solution or slurry.

7. A method as claimed in claim 6, wherein the amount of acacia gum in the solution or slurry is at least 39.9, 40, 41, 42, 43, 44, 45, 46, 47, 48, 49, 50, 55, 60, 65, 70, 75, 80 or 85% by weight of the solid content of the solution or slurry.

8. A method as claimed in claim 6, where the filler comprises one or more of alginate, chalk or glycerol.

9. A method as claimed in claim 6, where the amount of tobacco in the solution or slurry is no more than 20%, 15%, 10%, 5%, 4%, 3%, 2%, 1% or 0.5% by weight of the solid content of the solution or slurry.

10. A smoking article comprising a smokeable sheet material according to claim 1.

11. A smoking article as claimed in claim 10, further comprising tobacco.

12. A smokeable sheet material configured to reduce the level of one or more of the constituents of mainstream smoke generated upon use of a smoking article, wherein the sheet material comprises a filler, and greater than 39.5% acacia gum by weight, wherein the sheet material does not comprise substantially solid or particulate matter of a size greater than 50 μm, wherein the sheet material comprises no more than 25% tobacco by weight.

13. A smokeable sheet material according to claim 2, wherein the filler comprises one or more of alginate, chalk and glycerol.

14. A smokeable sheet material according to claim 2, wherein the sheet material does not comprise tobacco.

15. A smoking article comprising a smokeable sheet material according to claim 2.

16. A smoking article comprising a smokeable sheet material according to claim 3.

17. A smoking article comprising a smokeable sheet material according to claim 4.

18. A smoking article comprising a smokeable sheet material according to claim 5.

* * * * *